US006706314B2

(12) United States Patent
Butland

(10) Patent No.: US 6,706,314 B2
(45) Date of Patent: Mar. 16, 2004

(54) METHOD OF LABELLING AN OBJECT

(75) Inventor: Charles L. Butland, Playa del Rey, CA (US)

(73) Assignee: Amesbury Trust, Ramsey (GB)

( * ) Notice: Subject to any disclaimer, the term of this patent is extended or adjusted under 35 U.S.C. 154(b) by 455 days.

(21) Appl. No.: 09/808,838

(22) Filed: Mar. 15, 2001

(65) Prior Publication Data

US 2002/0167161 A1 Nov. 14, 2002

(51) Int. Cl.[7] ..... B41M 3/14

(52) U.S. Cl. ..... 427/7; 106/31.32; 252/301.4 R; 252/301.16; 427/157; 427/160; 427/256; 427/288; 427/384; 427/555; 427/596

(58) Field of Search ..... 106/31.32; 252/301.4 R, 252/301.16; 427/7, 157, 160, 256, 388, 384, 555, 596, 288

(56) References Cited

U.S. PATENT DOCUMENTS 5,427,526 A 6/1995 Fernandes 6,030,657 A * 2/2000 Butland et al. ..... 427/7

FOREIGN PATENT DOCUMENTS

WO WO 96 18972 6/1996

* cited by examiner

*Primary Examiner*—Bernard Pianalto
(74) *Attorney, Agent, or Firm*—Mueller and Smith, LPA

(57) ABSTRACT

The present invention in one aspect is directed to a method for labeling the durable surface of an object for its identification, which object has a durable surface or a durable surface tag affixed to the object. This method includes the use of "pit and fall" (i.e., holes and bumps as are used to record compact discs, CD-ROMs) technology to encode durable surface objects with coded message. The coded message can be information on the owner, a history of the object, or any other information desired. The coded message would not be detectable to the human eye; however, by scanning the pits and falls with a laser, the coded message could be detected and displayed. Such coded message encoding could be used, for example, to label objects for their identification in case of theft, or in case of product counterfeiting or diversion.

14 Claims, No Drawings

METHOD OF LABELLING AN OBJECT

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to the labeling of objects for verifying authenticity and more particularly to the use of selectively perceptible marks for labeling of objects. Authenticity implies both that the goods are genuine and that they are in the proper channels of commerce. If the goods are not genuine, then product counterfeiting has occurred and the present invention presents the ability to determine whether or not goods are genuine. If the goods have been diverted from their intended channel of commerce by, for example, entering into a country where the goods are prohibited, for example, by contract or by law, then the goods have been subject to product diversion. Again, the present invention presents the ability to determine whether genuine goods have been improperly diverted. Finally, the term, "diverted goods", also comprehends genuine goods, which have been stolen and the identity of the goods is at issue.

Many objects require verification for authentication purposes. Such objects include paintings, sculptures, cartoon cells, sports and other collectibles, and like works of art; videocassette recorders (VCRs), televisions, and like household objects; and computers; printers, and like office and business equipment. Other instances of identification in order to verify ownership, include, for example, records, audio and video tape cassettes, computer software recorded on floppy disks or diskettes, perfumes, designer clothes, handbags, briefcases, cartoon cells, automobile/airplane parts, securities (e.g., stock certificates), wills, identification cards (driver's licenses, passports, visas, green cards), credit cards, smart cards, and like objects. A flagrant piracy explosion over the past decade involving many of the foregoing products has plagued many industries. Often, these objects have no serial number or other unique means of identification, or the number can be removed easily following a theft. Alternatively, counterfeiting of such objects has become a thriving business and the need to identify authentic from counterfeit objects is of great importance.

In a related, but different, scenario, genuine goods are limited to being shipped and sold in selected jurisdictions (e.g., countries), for example, by law or by contract. When genuine goods are diverted to countries where their presence is not authorized, then "product diversion" has occurred. Product diversion can lead to, inter alia, price inequities in certain markets as well as loss of exclusivity by some manufacturers or distributors. This situation often is referred to as "gray market" goods. Since the goods are genuine, it is quite difficult to determine whether the goods have been improperly diverted. This is especially true for a variety of goods such as, for example, clothing.

In U.S. Pat. No. 5,599,578, there is disclosed a technique for labeling objects for their identification and/or authentication involving the use of a combination of a mark visible to the naked eye and a mark invisible to the naked eye. The invisible mark or component of the system is one or more of an ultraviolet radiation (UV) dye, an infrared (IR) dye, an ink that displays a selected measurable electrical resistivity, or a biologic marker which may be a protein, amino acid, DNA, polypeptide, hormone, or antibody.

U.S. Pat. No. 6,030,657 is directed to a method for labeling an object for its identification. This method includes providing a biologic marker labeled with an agent that emits selected detectable wavelengths of energy when exposed to infrared radiation (IR), and associating the labeled marker with the object, whereby, the object to be identified can be exposed to IR and emitted select wavelengths of energy from said agent detected. The agent can be an upconverting phosphor, a lanthenide ion (bound to a naphthalene group), or other chemical that emits selected detectable wavelengths of energy when exposed to infrared radiation (IR). The materials are encapsulated in an encapsulant that is resistant to the environment in which the materials are used such as, for example, an ink formulation. However, the encapsulant can be opened (e.g., by selective dissolving) and the materials inside (e.g., biologic, IR emitting, etc.) determined. A presently preferred encapsulant is casein which has been self cross-linked to provide resistance to hydrophobic ink formulations in which it desirably is placed.

BRIEF SUMMARY OF THE INVENTION

The present invention in one aspect is directed to a method for labeling the surface of an object for its identification, which object has a durable or hard surface or a durable surface tag affixed to the object. For present purposes, the term "durable" means a surface whose characteristics are such that it has memory for retaining the label applied thereto. Thus, the surface may be rigid or flexible, so long as the surface retains the label during use of the object and is readable. The inventive method further includes the use of "pit and fall" or "pit and land"(i.e., holes and bumps as are used to record compact discs, CD-ROMs) technology to encode durable surface objects with coded message. The coded message can be information on the owner, a history of the object, or any other information desired. The coded message would not be detectable to the human eye; however, by scanning the pits and falls with a laser, the coded message could be detected and displayed. Such coded message encoding could be used, for example, to label objects for their identification in case of theft, or in case of product counterfeiting or diversion. "Pit and land coded message", then, for present purposes comprehends data recorded in pit and falls ala CDs wherein the data is unique to the object and not generally known. By not being generally known (except for the manufacturer and those in confidence with the manufacturer), the authenticity/identity of the object can be assured. The object may contain pit and land data useful to the user of the object (e.g., CD, DVD, or the like); however, such pit and land audio and video data does not inform the manufacturer or anyone else of the authenticity/identity of the object. it only is the coded message of the present invention that contains such authentication/identification information (data) and that is within the scope of the present invention.

The pits and falls encoded information desirably is protected by a coating or overcoat to prevent the area encoded with the pits and falls information from becoming inadvertently or deliberately scratched, which would render retrieval of such information difficult, inaccurate, and/or meaningless. While a conventional coating transparent to the wavelength of the laser used to scan the pits and falls can be used, such coating additionally can be part of the security system, e.g., by containing a biologic marker labeled with an agent that emits selected detectable wavelengths of energy when exposed to infrared radiation (IR), and associating the labeled marker with the object, whereby, the object to be identified can be exposed to IR and emitted select wavelengths of energy from said agent detected. The agent can be an upconverting phosphor, a lanthenide ion (bound to a naphthalene group), or other chemical that emits selected detectable wavelengths of energy when exposed to infrared radiation (IR). The coating additionally may contain an agent that is perceptible only in the presence of ultraviolet (UV) radiation, e.g., fingerprint. Combinations of IR and UV agents may be used additionally. While the same laser beam wavelength could be used to read the pits and falls, detect the IR agent, preferably the wavelength for reading the pits and falls will be different than the wavelength used to detect the IR agent; thus, making it more difficult for the copyist to break the code. Additionally, the biologic marker can be encoded to further protect the object being labeled.

Advantages of the present invention include a simple, yet reliable means for labeling objects for identification. Another advantage is that a portion of the label is not perceptible to people absent the application of special techniques in order to determine the presence of such labels. Another advantage is that the label can last for an almost indefinite period of time. A yet further advantage is the ease and versatility for identification, which is afforded by the present invention. Another advantage is the ability to encrypt the biologics for embedding information, such as point of origin, for product diversion. These and other advantages will become readily apparent to those skilled in the art based upon the disclosure contained herein.

DETAILED DESCRIPTION OF THE INVENTION

Once an object is identified and the identification verified, it could be labeled in accordance with the inventive technique disclosed herein so that its authentication at a later date is materially enhanced. For present purposes, "permanent" as applied to the present labeling technique of an object means that the label is incapable of being removed from the object in the ordinary course of intended handling and usage of the object for a time adequate for identification and/or verification of the object to occur and/or is placed on the object at a location that is seldomly, if ever, accessed by the user in the ordinary course of using the object. For some objects, it may be desirable that the label remains affixed to the object and identifiable for many years. Such objects would include works of art, household and business appliances, machinery, automobiles, automobile parts, records, video audio tape cassettes, computer software diskettes, and the like. It is conceivable that some objects would require verification for only a limited time (e.g., for several days to several months); however, it is believed that extended verification time periods will find greater acceptance in the marketplace.

Most of these objects have an area that is a durable surface. If no durable surface is present and/or in addition thereto, a durable surface tag or label bearing the indicia could be affixed to the object to be labeled. For present purposes, a "durable surface" is a surface capable of being "burned" ala a compact disc (CD) to generate indicia thereon. Most durable surfaces will be polymeric, such as polycarbonates, acrylics, polyesters (e.g., Mylar® brand polyester film, E. I. du Pont de Nemours and Co.) and the like; although, other durable surface materials may be used, such as metals, ceramics, or the like. "Indicia" for present purposes comprehends both visible data and audio data. Visible data includes alphanumeric characters, graphics, and combinations thereof. Audio data includes sounds that can be "heard" either by the unaided ear of a listener or with the aid of a device. Thus, the audio data may be at a frequency beyond that that the ordinary listener can detect without the aid of a device or machine. Moreover, the indicia also can be encoded to further thwart counterfeiters.

A variety of CD manufacturing processes have been practiced commercially.

These include, inter alia:

- the stamper-injection molding technique where a glass master is coated with a photoreactive layer, which then is developed using a laser to create the required pattern of pits and land. The master disc then is electroformed to create a series of stamps for use in an injection molding process.
- the direct and write mastering (DRAW) technique which coats the master with plastic so that a 50 mW argon laser lathe operating at 488 nm vaporizes sections of the plastic for form the required pattern of pits and land. The master disc then is electroformed to create a series of stamps for use in an injection molding process.
- in direct metal mastering (DMM), the master disc is created using a piezoelectric stylus, tipped with a diamond cutting tip, to etch the surface of a metal disc. The resulting surface with its V-shaped grooves closely mimics the surface of a conventional CD disc to the reading laser. The resulting master then is electroformed to create stampers, as described above.
- in photopolymerization, a UV sensitive lacquer is sandwiched between a mold and a thin polycarbonate substrate. UV light then is shown through the substrate to cure the lacquer, resulting in a durable data surface. The disc then is metallized and covered with acrylic.
- photolithography involves UV light shown through a pre-cut mask onto plastic disks coated with a reflective layer from which a positive photoresist is made. The photoresist is developed by the light forming the required series of pits and lands.

Further information on this topic can be found, for example, at http://www.ee.washington.edu/conselec/W94/edward/edward.htm, the disclosure of which is expressly incorporated herein by reference.

While these numbers may vary, pits typically are about 0.5 microns wide, 0.83 to 3 microns long, and 0.15 microns deep. The space between adjacent tracks, the pitch, is just 1.6 microns. Track density can be in excess of 16,000 tpi. These dimensions make the pits and falls (lands) microscopic and unseen by the unaided human eye. Thus, such a system would make it nearly impossible to detect by the copyist or other actor. Couple such microscopic size with the ability to encode the information makes the present system truly unique and well suited to its uses, such as are described herein.

Any of the foregoing CD forming schemes, or others, may be used to generate the label either directly on a component of the object to be labeled or on a tag to be attached to the object to be labeled. A conventional reading laser and detector system, then, is used to "read" the pits and lands information recorded on the durable surface. When the durable surface coded message data is read, laser light of another fixed wavelength (say, 780 nm) is directed onto the durable surface. Details concerning the operation of laser players and CDs can be found, inter alia, in the following references: U.S. Pat. Nos. 5,195,082, 5,479,394, 5,606,541, 5,598,398, 5,617,387 and 5,172,368, the disclosures of which are expressly incorporated herein by reference.

Additionally, the inventive durable surface technique can be combined with other counterfeiting/anti-diversion techniques, such as those describe above. Particularly preferred is the encapsulated biologic marker technique disclosed in U.S. Pat. No. 6,030,657. Use of an overcoating containing the biologic marker would serve to not only protect the pit and fall area, but also would be part of the security system.

Suitable film-forming vehicles include, inter alia, acrylic resins, vinyl resins, urethane resins, urea resins, alkyd resins, unsaturated polyesters, epoxy resins, amine and phenol formaldehyde resins, and the like and mixtures thereof. Such resins may be thermoplastic or thermoset, but under conditions substantially preclusive to destruction of the markers used. See, for example, D. H. Solomon, *The Chemistry of Organic Film Formers*, Robert E. Krieger Publishing Co., Inc., Huntington, N.Y. (1967), the disclosure of which is expressly incorporated herein by reference.

Biologic markers can be placed in the coating that overcoats the pit and fall area. Biologic markers, such as amino acids and proteins are disclosed in U.S. Pat. No. 5,194,289, cited above. Such biologic materials can be profiled by gas chromatography which creates a standard for later comparison with a small (e.g., nanogram) sample of ink from a stolen object, a counterfeit object, or a diverted genuine object, which objects have been labeled in accordance with the precepts of the present invention. Additionally, U.S. Pat. No. 5,139,812 discloses the use of nucleic acid sequences in ink for identifying an object with a probe. U.S. Pat. No. 4,880,750 discloses the use of individual-specific antibodies (e.g., in an ink) for identification of security documents. U.S. Pat. No. 4,441,943 uses synthetic polypeptides for labeling explosives. British Patent No. 2,209,831 proposes to label objects with a nucleic acid, antibody, or antigen. U.S. Pat. No. 5,451,505 uses nucleic acids as taggants. U.S. Pat. No. 5,429,952 proposes to associate hapten with a product and then later detecting the presence of hapten with a complementary binding member and, thus, identify the product. MHC (major histocompatibility complex is yet another biologic marker suitable for use in the present invention. Thus, the term "biologic marker" should be construed broadly to include biologic materials (natural and synthetic, whole or fragments, naturally occurring, synthetic, and/or modified) for use in accordance with the precepts of the present invention. The disclosures of these citations are expressly incorporate herein by reference.

Such techniques also are not readily perceptible without the aid of special equipment and/or chemicals, which develop the presence of such markers. For present purposes, such markers are unique and not easily (if at all) replicated by the forger or counterfeiter. The foregoing biologic markers may be incorporated into a visible (of the same or a different color from the object or product being marked) or an invisible ink for use in labeling objects. It should be understood also that such biologic markers can be native or can be synthetic, including fragments, single chains, and a variety of additional forms currently developed or yet to be developed. It may even be feasible to radiolabel some biologic or other markers and determine their presence thereby.

Moreover, DNA (RNA, antibodies, antigens, and like biologics) can be used to encrypt and transport information in situ. The encoded messenger DNA (or mDNA) would be virtually impossible to detect and decode without prior knowledge of its presence and composition. A quantity in the femtogram range or just a few bacterial cells or bacteriophage particles would be sufficient to encode a complex message.

The biologic molecules may consist of a single biomolecule, which may have multiple traits (for example, size and weight) identifiable with the source of the product and/or destination of the product. Alternatively, the biomolecule can consist of a set of biomolecules (e.g., plasmids or fragments of nucleic acid or proteins), each differing in a single trait (e.g., size). Table 1, below, depicts the number of possible combinations, which can be derived from a given number of DNA segments.

TABLE 1

| Number of DNA Segments | Number of Combinations |
|---|---|
| 2 | 3 |
| 3 | 7 |
| 4 | 15 |
| 5 | 31 |
| 6 | 63 |
| 7 | 120 |
| 8 | 247 |
| 9 | 502 |
| 10 | 1,023 |
| 11 | 2,047 |
| 12 | 4,095 |
| 13 | 8,191 |
| 14 | 16,381 |
| 15 | 32,767 |
| 16 | 65,535 |

For example, with only 16 plasmids, 65,535 items of product can be uniquely labeled. It should be appreciated that the segments need not be DNA segments, but also can be RNA segments, segments of other proteins, or other biomolecules. Of importance in the present invention is that each biomolecule or segment differs from one another on the basis of a single trait. These traits include, inter alia, size, molecular weight, density, boiling point, melting point, freezing point, free energy, hydrophobicity, pow (log pow), degree of cooperative or anti-cooperative binding to a ligand, activity, surface tension, shape, sedimentation coefficient, diffusion coefficient, viscosity, absorption of radiation, emission of radiation, UV spectra, fluorescence, optical rotatory dispersion/circular dichroism, nuclear magnetic resonance, infrared spectra (Fourier transform or any other IR spectra), raman scattering, X-ray emission, X-ray scattering, X-ray diffraction, Bragg reflection of X-rays, electron or neutron diffraction, various parameters of protein folding, and the like. Thus, the power of the present invention lies not only in the secrecy of the location of the mark on the product and the use of multiple markers, but also on which trait of the markers is being used for the identification of source, destination, etc.

Additionally, the biomolecules also could differ from each other by more than one trait. Thus, for example, 2 plasmids may differ from each other by two traits (e.g., size and guanosine-cytosine (GC) content). This two-trait/two-plasmid combination leads to 15 possible combinations while as mere 8 biomolecules differing from each other in 8 traits leads to 65,535 combinations. This is a huge increase in the number of items of product that can be marked using fewer biomolecule by looking at multiple traits. The power of the present invention is, thus, revealed.

As a chemical method for determining the biologic identifiers, DNA or RNA identifiers can be labeled with biotinylated dATP or dUTP, respectively. To detect their presence on a product, the label can be removed, for example, form a shirt, and the DNA or RNA transferred to a nylon membrane and complexed with streptavidine-alkaline phosphatase. The complex formed, then, is detected by reaction with a chemiluminescent substrate sheet observed on X-ray film.

Just as the sequence of zeros and ones are used by a computer to form a binary code, the four organic bases of DNA (A, adenine; C, cytosine; G, guanine; T, thymine) can be used as a quaternary code. Combinations of the bases can be made to correspond to numbers and letters of the alphabet or to denote individual words or phrases. Just as the biological information is encoded by the sequence of the four bases along the DNA molecule, any desired information could be encoded by the development of a suitable encryption scheme. One such exemplary scheme is set forth in Table 2 below:

TABLE 2

| DNA Base | Corresponding Alphanumeric |
|---|---|
| C | A |
| G | B |
| T | C |
| AA | D |
| AC | E |
| AG | F |
| AT | G |
| CA | H |
| CC | I |
| CG | J |
| CT | K |
| GA | L |
| GC | M |
| GG | N |
| GT | O |
| TT | P |
| TA | Q |
| TC | R |
| TG | S |
| AAA | T |
| AAC | U |
| AAG | V |
| AAT | W |
| ACC | X |
| ACA | Y |
| ACG | Z |
| A | Space |
| ACT | . |
| AGG | 1 |
| AGA | 2 |
| AGC | 3 |
| AGT | 4 |
| ATT | 5 |
| ATA | 6 |
| ATC | 7 |
| ATG | 8 |
| CAC | 9 |
| CTC | 0 |

In practice, a message would be encoded using a suitable encryption scheme or code, and the corresponding DNA sequence chemically synthesized by one of several commonly used methods. Using one of these methods, it is possible to construct single stranded DNA molecules approximately 80 to 100 base pairs in length. If the message were required to be longer, two different sequences could be made, such that one of their ends could form a double-stranded region. The remaining single stranded regions then could be made double stranded using standard enzymatic methods. In this way, someone versed in the art could form a larger information-containing molecule than is possible using chemical synthesis alone. By combining a number of single stranded molecules in this way, a double stranded molecule of theoretically unlimited length could be made.

In order to propagate the information, the double stranded DNA message could be cloned into any of a variety of cloning vectors and hosts that are readily available, or could be constructed by someone versed in this art. The mDNA could be transported as the double stranded DNA, as the DNA ligated to a suitable vector, or in a bacterial or bacteriophage host, or a virus. Use of the host or the cloned mDNA adsorbed dry to a variety of surfaces as the vehicle for transporting the message could make it virtually impossible to detect by direct methods.

In particular, a bacteria or bacteriophage or a virus could be adsorbed to a variety of surfaces and be undetectable until it was grown in a suitable media or host. Selective genetic features could be engineered into the host-vector combination that would make it difficult or impossible to recover unless the right combination of conditions was used. Once the mDNA has been recovered using suitable means, it could be decoded in a number of ways.

The most complete way being determining the actual sequence of the mDNA by one or more of a variety of well-known methods and decoding it according to the encryption scheme that had been used. The other way would be to use a DNA probe to detect the presence of particular sequences. This would require that some knowledge of the sequence of the message be known. This method could be used to determine which of a number of possible alternative messages had been sent. The number of possibilities could be quite large, on the order of hundreds of thousands, as the technology for making and detecting the hybridization of DNA probes is highly developed and, in some instances, is automated.

One product diversion implementation of the foregoing encoding embodiment of the present invention involves the application of the DNA matrix (the matrix being a liquid vehicle, such as, for example, a transparent or opaque ink or other liquid sprayable vehicle), transparent to pit and fall laser reading beam, and phosphor via spray or other application techniques (e.g., mechanical, air, airless, air-assisted airless spray; laser, inkjet, bubblejet, including ink and screen printing; or the like) with provision for injection of a pre-determined DNA sequence (encoded DNA) over the pit and fall area. The spray equipment could be fixed or portable. An exemplary use, for example, would be in the marking of labels for application to clothing or other products, which often is subject to diversion. In order to be able to determine whether the product had been diverted, a known DNA sequence would be injected into the spray of matrix and phosphor so that the specific lot of product, say clothing, could be identified at a later date should its diversion become an issue. The DNA sequence, then, would be changed for different lots simply by varying the DNA sequence injected into the spray equipment. Such encoding technique coupled with the pit and fall information provides a technique for uniquely identifying products.

The DNA or other biologic marker preferably is encapsulated or microencapsulated in a standard encapsulating medium, e.g., casein, for use in marking an object. Amber or Saran Wrap, for example, may be suitable for encasing biomolecules also. Moreover, the capsule material itself may be biologic in nature. For example, nucleic acid can be used to transform a spore-forming bacteria, such as Bacillus or Clostridium. Heating the spore-forming bacteria produces heat and UV resistant spores with which to protect the nucleic acid identifier. Note, that in this example, the spores also function to mask the nucleic acid identifier since the spore masks UV response traits. The spores used may be conidiospores or endospores. Additional biologic encapsulants include, iner alia, a virus, or a bacteria. Presently preferred is casein encapsulant which has been cross-linked with itself to provide a shell which is resistant to environmental insults for protection of the DNA therewithin, e.g., plasmids with cloned inserts carrying specific DNA sequences wherein the inserts are all of specific defined lengths. Fatty or lipoidal material, plastics or other polymers, also can be considered as suitable encapsulants provided that they do not adversely interact with the DNA or other biologic medium and can be selectively "opened" to reveal the biologic for analysis (and the phosphor for IR detection). The size of the encapsulated biologic materials desirably is on the order of a few microns in size, but can range on up to a millimeter or so, depending upon its intended use.

Alternatively, the DNA could be bound to magnetic microbeads and the magnetic presence determined, such as is proposed in U.S. Pat. No. 5,360,628, in addition to the use of the phosphors or instead of using the phosphors. For example, DNA which is plasmid in size having a lacZ reporter gene can be bound to a DNA-bindable chemical. Magnetic beads (e.g., 1 Ê size) are coated with lad repressor protein, which will bind the plasmid DNA. Then beads, then, can be coated with saran wrap or amber to protect the plasmid. The coated beads then are affixed to the object to be marked and the saran wrap or amber is removed. A Hall Effect or similar device can be used to detect the magnetic beads on the object. Plasmid DNA can be eluted from the magnetic beads using, for example, IPTG and the plasmid DNA sequenced, if necessary, to identify the object with the known sequence. Reference also is made to *Biotechiques*, vol. 14, pp 624–629 (1993), the disclosure of which is expressly incorporated herein by reference.

While both up-converting and down-converting phosphors may be used, a particularly useful phosphor is a rare earth oxysulfide, such as selected from those phosphors as described in British patent application 2,258,659 published on Feb. 17, 1993, this disclosure of which is expressly incorporated herein by reference. Such phosphors are described as doped yttrium oxysulphide ($Y_2O_2S$), in which the dopants comprise, by weight of the oxysulphide, 4% to 50% of one or both of erbium (Er) and ytterbium (Yb). The material may comprise 1 to 50 ppm of one or more other lanthanide elements. Erbium and ytterbium may be replaced by thulium (Tm), holmium (Ho), or lutetium (Lu). The material may be in the form of particles whose average size is no more than 20 $\mu$m. Reference also is made to O'Yocom, et al., "Rare-Earth-Doped Oxysulfides for Gallium Arsenide-Pumped Lumines Devices", *Met. Trans.*, (1971), 2(3), 763–767, and Wittke, et al, "Erbium-Ytterbium Double Doped Yttrium Oxide. New Red-Emitting Infrared-Excited Phosphor", *J. Appl. Phys.*, (1972), 43(2), 595–600, the disclosures of which are expressly incorporated herein by reference.

With respect to the phosphor as described above (e.g., gallium oxysulfide), such up-converting phosphors require high (peak power) density photon radiation in order to excite emission. A 10 Hz pulsed LED in the 880 nm region of the spectrum with approximately 50 mW peak power should be suitable therefor. With respect to the detector equipment, a simple illuminator can be used where human perception of a greenish glow to determine the presence of the security phosphor is employed.

Another proposed illuminator/detector could be manufactured from a flashing LED with a very narrow pulse width due to the fact that human perception is unnecessary. Such detector could have an optical filter that blocks IR illumination frequency and passes only the frequency of radiation emitted by the phosphor, i.e., target frequency. Such a detector could be used under high ambient light conditions. Such a detector could be configured as a simple swipe-type reader or could have a hinged or removable gate to expose the phosphor to the LED.

A proposed illuminator/detector/reader could have the ability to read encoded patterns of the embedded phosphor, such as, for example, a bar code. The reading capability can be provided by suitable software, such as bar code reader engines.

As an alternative and/or adjunct to phosphors, luminescent labeling based on the lanthenide ions, samarium (III), europium (III), terbium (III), and dysprosium (III), bound by a chelating agent, could be used as labels for DNA, modified DNA, DNA bases, or other biologic markers. Luminescence from such rare earth ions is generated by exciting the naphthalene group attached to the chelating agent. Thus, light shined on the naphthalene group, which has a long-lived excited state, eventually gives up this excitation energy to the lanthenide ion, which responds by emitting light. Because of the way that the lanthenide ions are linked to naphthalene, a single wavelength of light can excite all four labels, each of them emitting light of a characteristic wavelength. Moreover, the emission bandwidths of the lanthenide ions are narrow, even at room temperature in fluid solution, allowing them to be detected simultaneously with minimum overlap.

Because the lifetimes of the excited states of these ions are relatively long, emission detection can be time-gated, virtually eliminating signals from background sources. Time-gating, for present purposes, comprehends use of a pulsed excitation source which allows a time delay between excitation and detection. Thus, the time delay before detection permits sources of interfering light, such as scattered excitation light, Raman scattering, and impurity fluorescence, to die down before detection is initiated. Another advantage of the lanthenide ions is that they are compatible with both capillary gel electrophoresis, which is considerably faster than conventional sequencing using slab gel electrophoresis, and computer collection and analysis of data.

As another aspect of the present invention, the biologic marker used to identify the product can be masked to be virtually undetectable by an observer who has no knowledge of the traits of the biomolecule, which is associated with the product as its identifier. For example, a mask set of polypeptides can be added to a sequence of amino acids or nucleotides of a polypeptide (or protein). The counterfeiter, thief, or diverter will not easily be able to determine which molecule is the identifier from the combination of the mask molecules and the identifier molecule. Thus, the set of identifiers may differ from each other by a trait, which is different than the trait, which distinguishes the set of mask molecules. Alternatively, the mask biomolecule can include molecules which each differ in a trait which is the same trait as the identifier biomolecule, wherein not all members of the mask set have the same magnitude as all members of the identifier set.

The biological mask also can be less tailored to the first identifier, such as, for example, by including junk DNA such as, for example, salmon sperm DNA or calf thymus DNA. For a counterfeiter, thief, or diverter to discern a small concentration of the identifier biomolecule in a large concentration of junk DNA would be expensive, not unlike looking for the proverbial needle in haystack.

By analogy, the other markers of the present invention also can be masked. For example, one or more magnetic insulators can mask the magnetic identifiers, such as magnetic garnet—for example, gadolinium iron garnet (GdIG) or yttrium iron garnet (YIG) and derivatives and analogs thereof. An optical mask may consist of glass, sand, or another anisotropic material whose function is to provide light of multiple frequencies in order that the presence of the optical identifier is undetectable. Thus, the inventive masking technique has broad application in accordance with the precepts of the present invention.

Fluorescent dyes useful in incorporating into the overcoat coating include, for example, various rhodamines, such as Columbia Blue, 8-hydroxy-1,3,6-pyrenetrisulfonic acid trisodium salt (HOPSA, Eastman Chemical Company), Rhodamine B, or Hostacell yellow 8G (American Hoechst Corporation). The ultra-violet source exposes the labels when shined on the object at the appropriate location where the label is located.

Electrically conductive coatings or inks which utilize electrically-conductive particles is yet another technique for "invisibly" labeling an object and protecting the pit and fall area. The visible mark itself could be applied to the object using inks that exhibit a predetermined electrical resistivity. Use of electrically-conductive pigments, e.g., carbon, silver, gold, copper, aluminum, or the like, renders the ink electrically conductive which enables its resistivity to easily measured even in the field. In fact, use of magnetic particles, (e.g., iron oxide) may even produce a coating that can be identified by its magnetic properties.

Appropriate binders for compounding the overcoating comprise hardenable materials, including, for example, thermoplastic and/or thermoset resins, and penetrating carriers effective in establishing chemical and/or physical association of material with the surface of the object being labeled. Thermoplastic resins include, for example, polyesters, urethanes, acrylics, ethylene vinyl acetate copolymers, vinyl chloride homopolymers and copolymers, styrene butadiene polymers, styrene acrylonitrile polymers, silicone resins, cellulosic resins, ionomers, and the like and mixtures thereof. Thermosetting materials include, for example, air drying polyesters, urethane-forming resins formulated from polyols and polyisocyanates, conventional two-component epoxy resins with conventional hardeners (e.g., polyamine resins), UV curable resins, moisture-curable urethane resins, enzyme-curable resins, electron beam curable resins, radio-frequency curable resins, and the like, and mixtures thereof.

Specific examples include, for example, latex copolymers including methyl methacrylate/ethyl acrylate copolymers, styrene/butyl acrylate copolymers, styrene/butadiene copolymers, styrene/butyl acrylate/methacrylic acid/acrylic acid copolymers, methyl methacrylate/methacrylic acid/ethyl acrylate copolymers, methacrylic acid/butadiene/styrene copolymers, methyl methacrylate/butyl acrylate copolymers, butadiene/methacrylic acid copolymers, butadiene/acrylonitrile/methacrylic acid copolymers, butadiene/acrylonitrile/methacrylic acid copolymers, methacrylic acid/methyl methacrylate/ethyl acrylate/acrylic acid/ethyl acrylate copolymers; tongue oil/fumaric acid/pentaerythritol copolymers, and the like and mixtures thereof. Thus, it will be observed that a wide variety of thermoplastic and thermoset materials are suitable for use in accordance with the precepts of the present invention. So long as the binder, optionally with a solvent, can retain the UV dye, IR phosphor, biologic agent, etc., and provide permanence on the object being labeled for protecting the pit and fall area, such binder is suitable for use in accordance with the precepts of the present invention. Moreover, the method of application (e.g., spray, screen printing, or the like) often will dictate the materials used in formulating the overcoating, so that conventional coatings formulations tailored for used with the method of application is within the precepts of the present invention.

In the product diversion and anti-counterfeiting fields, products intended for a particular destination will have a particular indicia characterized and the destination will have possession of such characteristics. Upon receipt of the goods, the authorized destination will decode the indicia, for example, to verify a match of those characteristics. Such matching of characteristics or traits can be performed with the aid of a computer, as those skilled in this field will appreciate. Counterfeit goods, of course, will either lack the label or will have a counterfeit label, which lacks correspondence with the authentic traits of indicia, etc.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated. Also, all citations referred herein are expressly incorporated herein by reference.

What is claimed is:

1. A method for labeling an object for its identification, which comprises the steps of:

(a) forming a pit and land coded message on a durable surface selected from one or more of a surface of said object or a tag which is attached to said object; and (b) overcoating said coded message with a coating, which comprises capsules formed from an encapsulant which encapsulates a biologic marker which are labeled with an agent that emits selected detectable wavelengths of energy when exposed to infrared radiation (IR), said capsules dispersed in a film-forming vehicle.

2. The method of claim 1, wherein said coded message is readable with a laser reader system.

3. The method of claim 1, wherein said biologic marker is formed form encoded DNA bases.

4. The method of claim 3, wherein said encoded DNA bases are encoded with information to determine the place of origin of an object to which the label is affixed.

5. The method of claim 1, wherein said agent is an up-converting phosphor.

6. The method of claim 1, wherein said agent is a lanthenide ion bound to a napthalene group.

7. The method of claim 1, wherein said lanthenide ion is selected from the group consisting essentially of samarium (III), europium (III), terbium (III), dysprosium (III), and mixtures thereof.

8. The method of claim 1, wherein said film-forming vehicle is one or more of acrylic resins, vinyl resins, urethane resins, urea resins, alkyd resins, polyesters, epoxy resins, or amine and phenol formaldehyde resins.

9. The method of claim 1, which is dispersed in a liquid matrix for spray application onto an object to be labeled.

10. The method of claim 1, wherein said encapsulant is casein, which has been cross-linked with itself.

11. The method of claim 1, wherein said capsules range in size from about 1 micron to about 1 millimeter.

12. The method of claim 1, wherein said capsules also contain a mask.

13. The method of claim 1, wherein said biologic marker comprises MHC.

14. The method of claim 1, wherein said encapsulant is a virus or a bacteria.

* * * * *